US007383708B2

(12) United States Patent
Liu et al.

(10) Patent No.: US 7,383,708 B2
(45) Date of Patent: Jun. 10, 2008

(54) MULTISTAGE LOCK CYLINDER ASSEMBLY

(76) Inventors: Wen-Kuei Liu, No. 10, Lane 54, Sec. 3, Reh Her Rd., Taichung (TW); Chao-Hsuan Liu, No. 36, Singfong Shanjhuang, Tanzih Hsiang, Taichung Hsien (TW); Yu-Chun Liu, No. 36, Singfong Shanjhuang, Tanzih Hsiang, Taichung Hsien (TW)

( * ) Notice: Subject to any disclaimer, the term of this patent is extended or adjusted under 35 U.S.C. 154(b) by 52 days.

(21) Appl. No.: 11/409,975

(22) Filed: Apr. 25, 2006

(65) Prior Publication Data

US 2007/0245785 A1 Oct. 25, 2007

(51) Int. Cl.
*E05B 37/02* (2006.01)

(52) U.S. Cl. ..... 70/310; 70/301; 70/302; 70/305

(58) Field of Classification Search ..... 70/301–302, 70/304–306, 309–310
See application file for complete search history.

(56) References Cited

U.S. PATENT DOCUMENTS 1,263,062 A * 4/1918 Ikeda ..... 70/310
1,297,616 A * 3/1919 Wegner ..... 70/310
1,308,487 A * 7/1919 Eaton ..... 70/25
1,391,357 A * 9/1921 Richard ..... 70/310
1,595,979 A * 8/1926 Barker ..... 70/299
2,344,088 A * 3/1944 Hinnerfeldt ..... 70/310
2,584,655 A * 2/1952 Amo ..... 70/138
2,679,743 A * 6/1954 Quintero ..... 70/129
3,098,376 A * 7/1963 Miller ..... 70/333 R
3,611,761 A * 10/1971 Atkinson ..... 70/129
3,801,761 A * 4/1974 Green ..... 70/302
4,104,896 A * 8/1978 Hahn ..... 70/310

FOREIGN PATENT DOCUMENTS

GB 2115056 A * 9/1983

* cited by examiner

*Primary Examiner*—Patricia Engle
*Assistant Examiner*—Christopher Boswell
(74) *Attorney, Agent, or Firm*—Rosenberg, Klein & Lee

(57) ABSTRACT

A lock cylinder assembly has a base, multiple selecting disks and multiple disk sets. The base has an axis. The selecting disks are rotatably connected to the base along the axis of the base. The disk sets are operationally mounted along the axis of the base and are respectively connected to the selecting disks. Each disk set has multiple disks operationally mounted along the axis of the base. Accordingly, a lock cylinder assembly that can increase the difficulty of unlocking the lock cylinder assembly to improve the safety of using the lock cylinder assembly is provided.

16 Claims, 10 Drawing Sheets

MULTISTAGE LOCK CYLINDER ASSEMBLY

BACKGROUND OF THE INVENTION

1. Field of the Invention

The present invention relates to a lock cylinder assembly, and more particularly to a multistage lock cylinder assembly to improve the safety provided by the lock cylinder assembly.

2. Description of Related Art

With reference to FIGS. 9 and 10, a conventional lock cylinder assembly applied for a lock device in accordance with the prior art comprises a base (50), a knob (54) and a disk set (60). The base has a central tube (51), multiple through holes (52) and an indicator (55). The central tube (51) is formed on and extends from the base (50). The through holes (52) are defined through the base (50) and around the central tube (51). With multiple fasteners extending through the through holes (52), the base (50) is secured to an object on which the lock cylinder assembly is mounted. The knob (54) is rotatably mounted on the base (50) and has a driving rod (53) extending through the base (50) and the central tube (51). The knob (54) has multiple number signs corresponding to the indicator (55) on the base (50) to provide an indicating effect to the user for rotating the knob (54). The disk set (60) is connected to the driving rod (53) of the knob (54) and comprises a driving disk (63) and two driven disks (61,62). The driving disk (63) is secured on the driving rod (53), and the driven disks (61,62) are rotatably mounted around the central tube (51). Each disk (61,62,63) has a notch (611,621,631) defined in the periphery of the disk (61,62,63) and has at least one protrusion (612,622, 623,632) formed on at least one side of the disk (61,62,63). With the abutment between the protrusions (612,622,623, 632), the driven disks (61,62) are rotated with the driving disk (63) when the knob (54) is rotated.

When the disks (61,62,63) are rotated to make the notches (611,621,631) in aligning with each other, the notches (611,621,631) in the disks (61,62,63) will implement a space allowing a locking bolt extending into the space. Consequently, the locking bolt can be removed from a locking cavity to make a lock device with the locking cylinder assembly in an unlocked condition. When the disks (61,62, 63) are rotated to make the notches (611,621,631) misaligning with each other, the locking bolt will not be escaped from the lock cavity so that the lock device with the lock cylinder assembly is in a locked condition.

However, the conventional lock cylinder assembly has only one disk set (60) including three disks (61,62,63), to unlock the lock cylinder assembly only needs three passwords, is easy and takes few time for an unauthorized person. Therefore, the safety of using the conventional lock cylinder assembly needs to be improved.

To overcome the shortcomings, the present invention tends to provide a lock cylinder assembly to mitigate or obviate the aforementioned problems.

SUMMARY OF THE INVENTION

The main objective of the invention is to provide a lock cylinder assembly that can increase the difficulty of unlocking the lock cylinder assembly to improve the safety of using the lock cylinder assembly.

The lock cylinder assembly has a base, multiple selecting disks and multiple disk sets. The base has an axis. The selecting disks are rotatably connected to the base along the axis of the base. The disk sets are operationally mounted along the axis of the base and are respectively connected to the selecting disks. Each disk set has multiple disks operationally mounted along the axis of the base.

Other objects, advantages and novel features of the invention will become more apparent from the following detailed description when taken in conjunction with the accompanying drawings.

DETAILED DESCRIPTION OF PREFERRED EMBODIMENT

Figure 1:
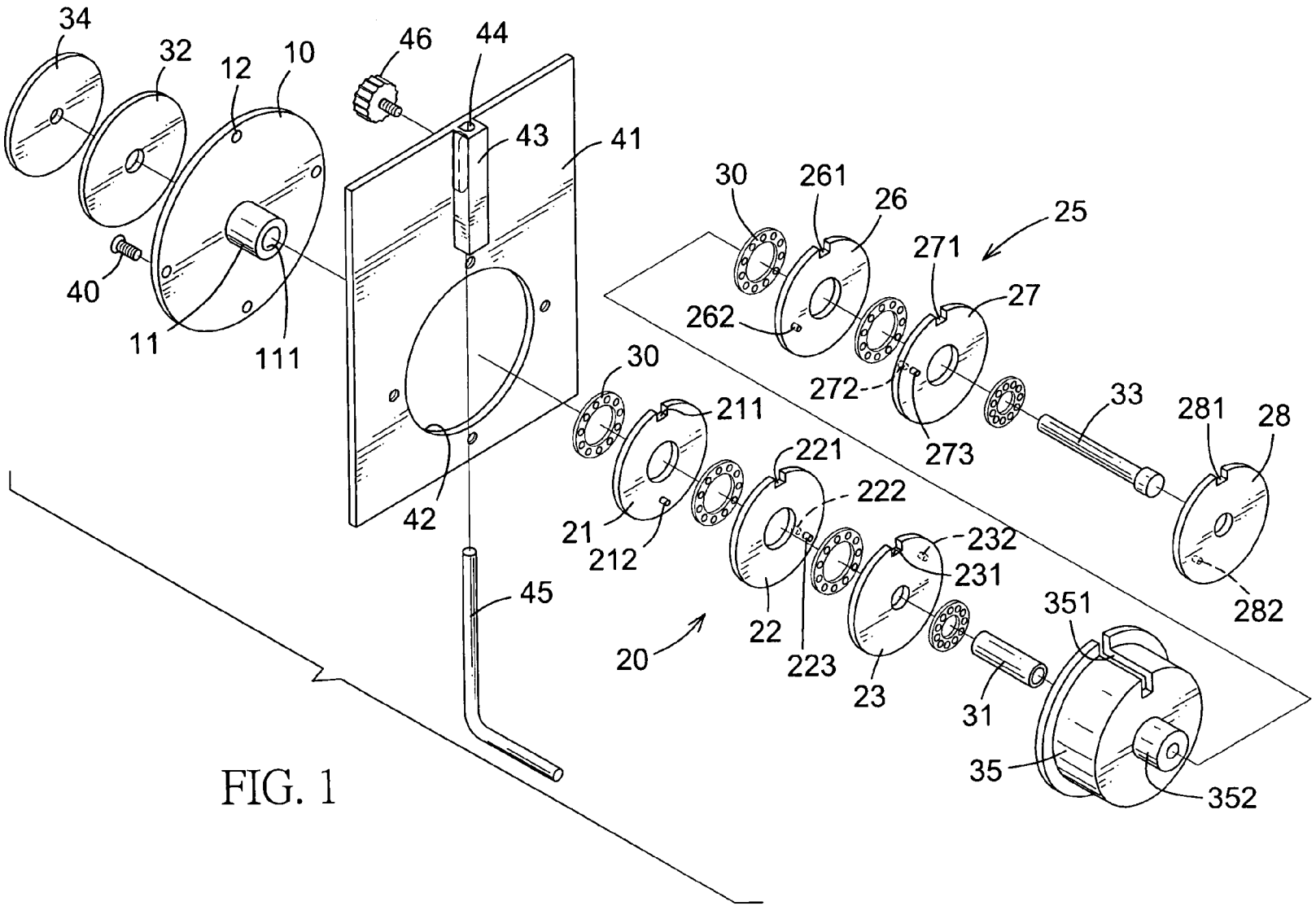
FIG. 1 is an exploded perspective view of a lock device with a lock cylinder assembly in accordance with the present invention.
Figure 2:
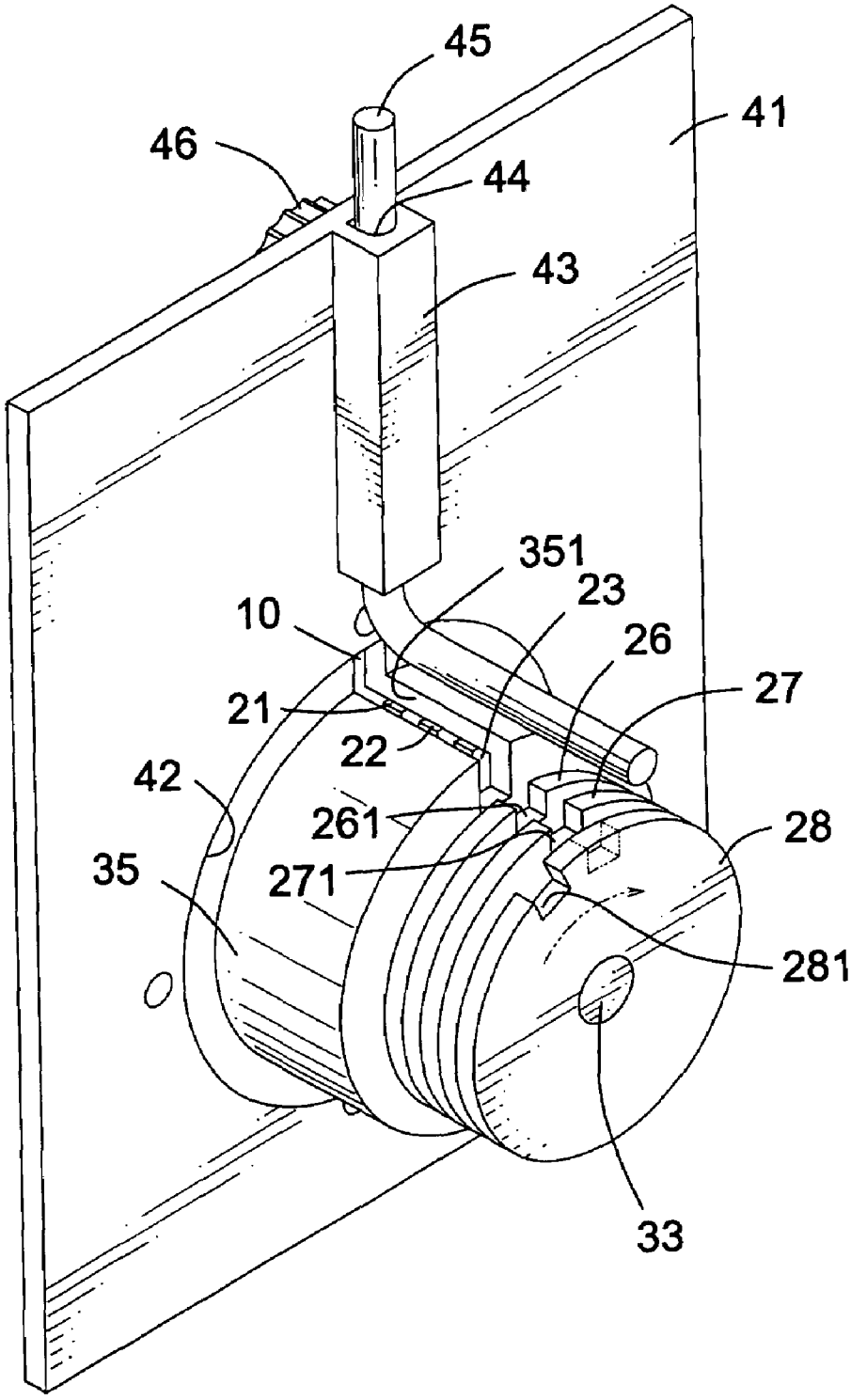
FIG. 2 is a perspective view of the lock device with the lock cylinder 12 assembly in FIG. 1.
Figure 3:
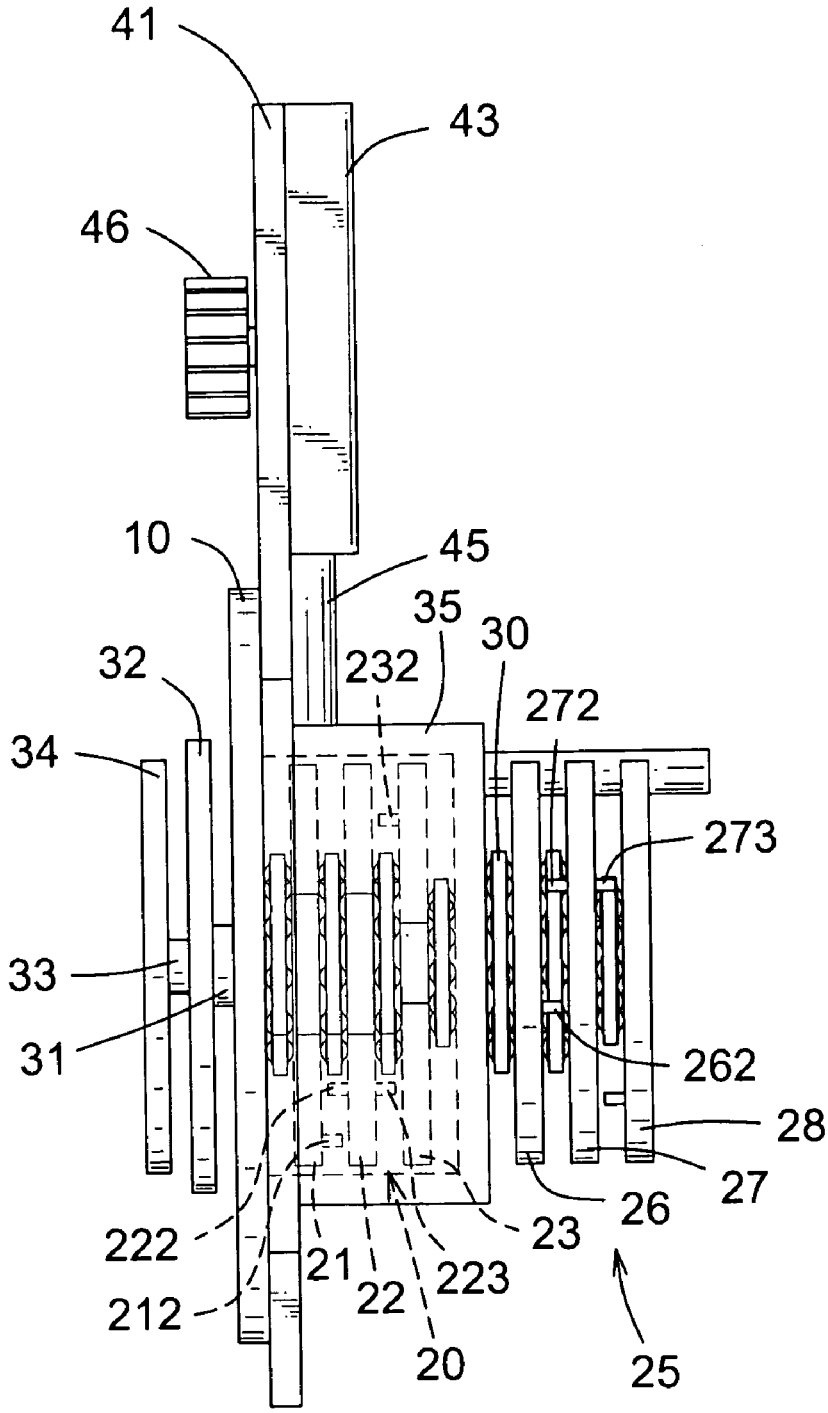
FIG. 3 is a side plan view of the lock device with the lock cylinder assembly in FIG. 1.
Figure 4:
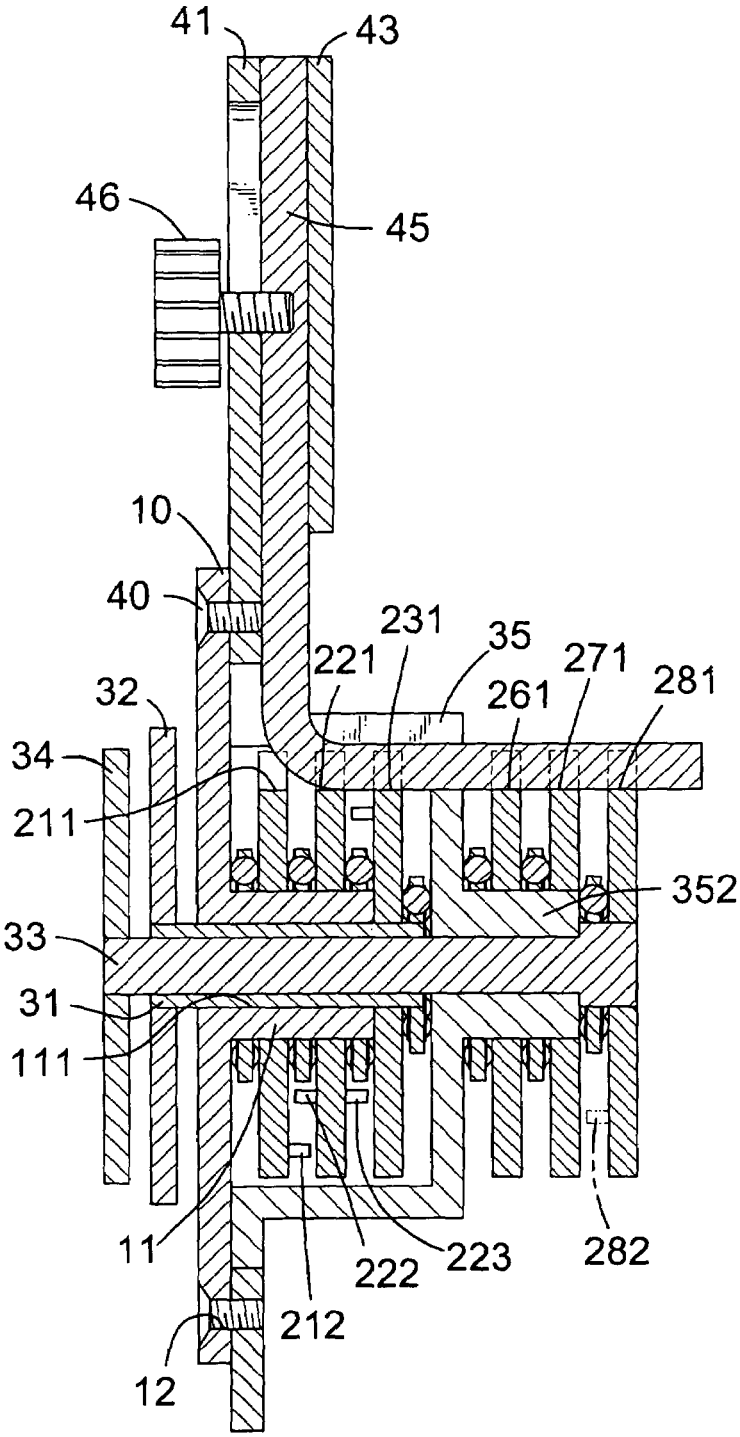
FIG. 4 is a side plan view in partial section of the lock device with the lock cylinder assembly in FIG. 1 showing that the lock device is in an unlocked condition.
Figure 5:
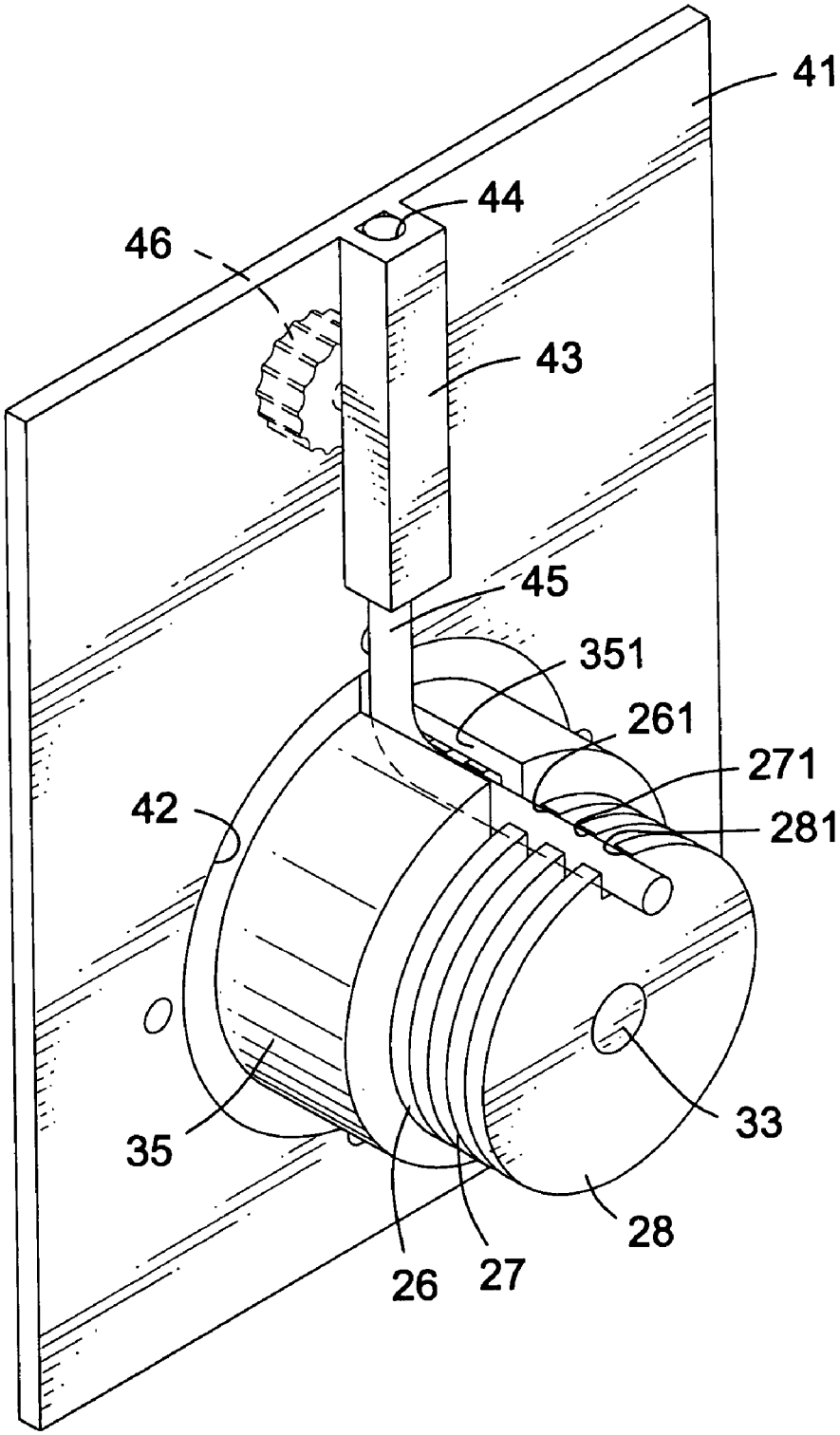
FIG. 5 is a perspective view of the lock device with the lock cylinder assembly in FIG. 1 showing that the lock device is in an unlocked condition.

With reference to FIGS. 1 to 5, a lock cylinder assembly in accordance with the present invention is applied for a lock device and comprises a base (10), multiple selecting disks (32,34) and multiple disk sets (20,25). The lock device has a board (41), an L-shaped lock bolt (45) and a knob (46). The board (41) has a bolt holder (43) formed on one side of the board (41). The bolt holder (43) has a channel (44) defined through the bolt holder (43). The L-shaped lock bolt (45) has a first end slidably inserted into the channel (44) in the bolt holder (43) and a second end corresponding to the lock cylinder assembly. The knob (46) movably extends into the bolt holder (43) and is securely connected to the first end of the lock bolt (45) to move the lock bolt (45) along the channel (44) in the bolt holder (43).

Figure 6:
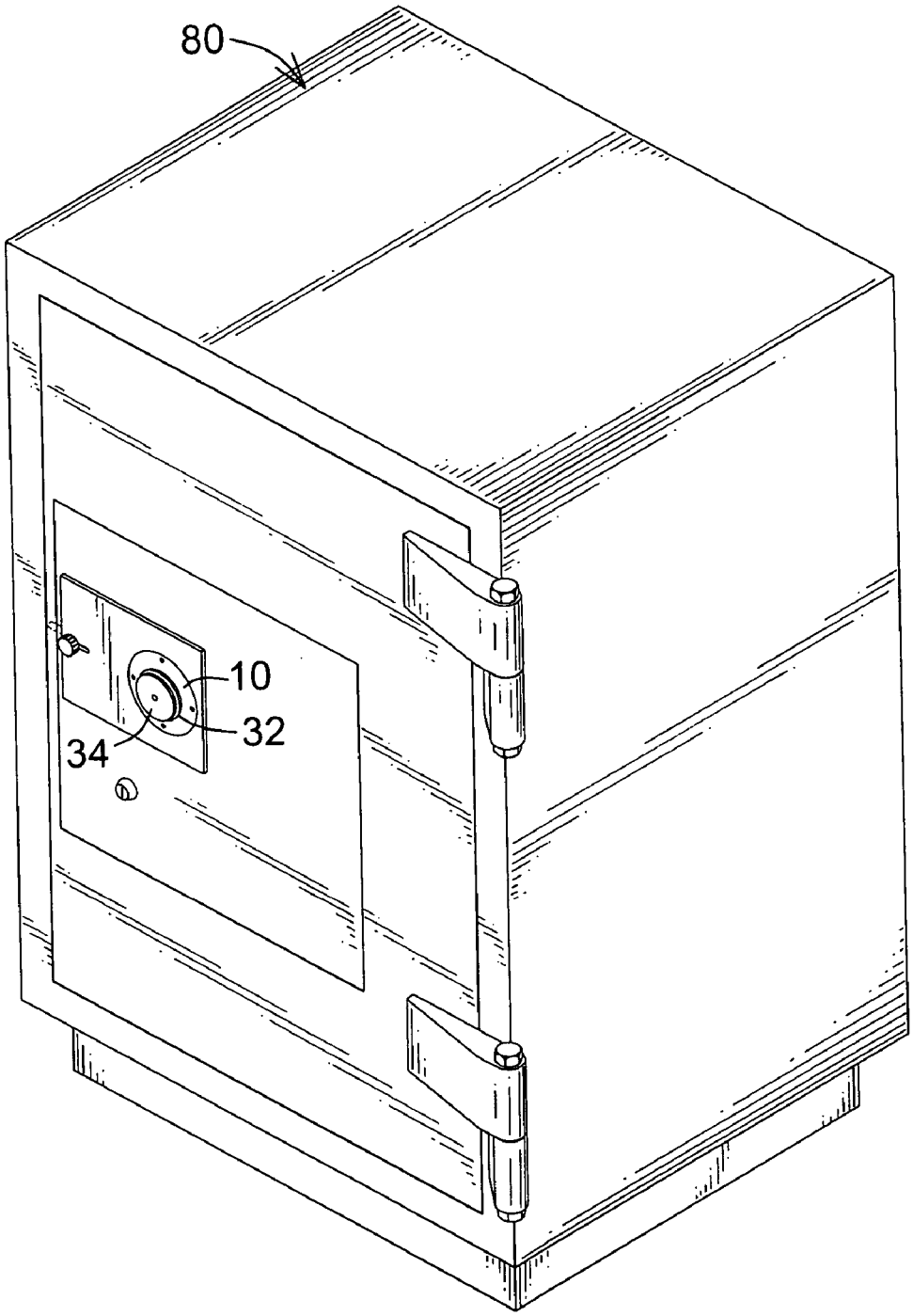
FIG. 6 is a perspective view of a safe having the lock device with the lock cylinder assembly in FIG. 1.
Figure 7:
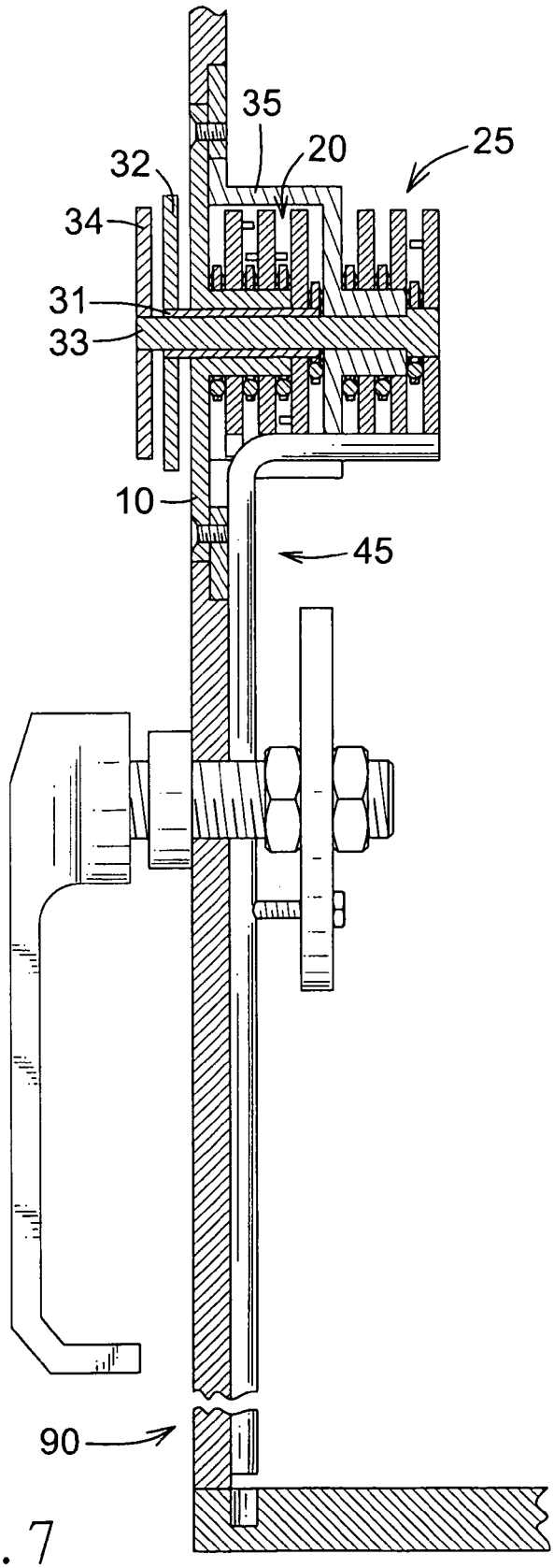
FIG. 7 is top view in partial section of a door having the lock device with the lock cylinder assembly in FIG. 1.

The base (10) has an axis and a central tube (11) extending from the base (10) along the axis and multiple through holes (12) defined through the base (10) and around the central tube (11). The central tube (11) has a central hole (111) axially defined through the central tube (11). With multiple fasteners (40) extending respectively through the through holes (12), the base is securely attached to the board (41) of the lock device which is mounted on an object, such as a safe (80) or a door (90) as shown in FIGS. 6 and 7. In addition, an indicator is formed on the base (10).

The selecting disks (32,34) are rotatably connected to the base (10) along the axis of the base (10). In the first embodiment, the lock cylinder assembly has two selecting disks (32,34) including a first selecting disk (32) and a second selecting disk (34). To connect the selecting disks (32,34) to the base (10), a driving sleeve (31) and a driving rod (33) are provided. The driving sleeve (31) rotatably extends through the central hole (111) in the central tube (11) on the base (10) and has an outer end and an inner end. The driving rod (33) rotatably extends through the driving sleeve (31) and has an outer end extending out of the outer end of the driving sleeve (31) and an inner end extending out of the inner end of the driving sleeve (31).

The first selecting disk (32) is securely mounted on the outer end of the driving sleeve (31) and has multiple number signs around the first selecting disk (32) and corresponding to the indicator on the base (10) to provide an indicating effect to the user for rotating the first selecting disk (32).

The second selecting disk (34) is securely mounted on the outer end of the driving rod (33) and has multiple number signs around the second selecting disk (34) and corresponding to the indicator on the base (10) to provide an indicating effect to the user for rotating the second selecting disk (34).

The disk sets (20,25) are operationally mounted along the axis of the base (10) and are respectively connected to the selecting disks (32,34). Each disk set (20,25) has multiple disks (21,22,23,26,27,28) operationally mounted along the axis of the base (10). In the first embodiment, the lock cylinder assembly comprises two disk sets (20,25) including a first disk set (20) and a second disk set (25).

The first disk set (20) is rotatably connected to the first selecting disk (32) with the driving sleeve (31) and includes a first driving disk (23) and at least one first driven disk (21,22). The first driving disk (23) is securely mounted on the inner end of the driving sleeve (31). The at least one first driven disk (21,22) is rotatably mounted around the central tube (11) on the base (10) and is connected to and driven by the first driving disk (23).

In a preferred embodiment, the first disk set (20) has two first driven disks (21,22). Each disk (21,22,23) has a notch (211,221,231) defined in a periphery of the disk (21,22,23). To operationally connect the disks (21,22,23), the first driving disk (23) has a driving post (232) extending toward an adjacent first driven disk (22). The first driven disk (22) adjacent to the first driving disk (21) has a driven post (223) and a driving post (222). The driven post (223) is formed on and extends from the first driven disk (22) at one side facing the first driving disk (23) and corresponds to and selectively abuts against the driving post (231) on the first driving disk (23). The driving post (222) is formed on and extends from the first driven disk (22) at one side away from the first driving disk (23). The first driven disk (21) far away from the first driving disk (23) has a driven post (212) formed on and extending from the first driven disk (21) at one side facing the adjacent first driven disk (22) and corresponding to and selectively abutting against the driving post (222) on the adjacent first driven disk (22). With the abutment between the driving posts (222,232) and the driven posts (212,223) on the disks (21,22,23), the first driven disks (21,22) will be rotated with the first driving disk (23) when the first selecting disk (32) is rotated.

In addition, the first disk set (20) further comprises multiple spacers (30) with multiple rotors mounted around the central tube (11) on the base (10) and between the base (10), the first driven disks (21,22) and the first driving disk (23). With the arrangement of the spacers (30), the rotation of the driven disks (21,22) is at a lower friction and smooth.

The second disk set (25) is operationally connected to the base (10) with a disk holder (35) and is rotatably connected to the second selecting disk (34) with the driving rod (33). The disk holder (35) is attached to the base (10) and is mounted in a hole (42) defined in the board (41) of the lock device to hold the first disk set (20) inside and has a stub (352) axially protruding from the disk holder (35). The disk holder (35) can be secured to the base (10) with fasteners or a soldering or a welding process. The driving rod (33) rotatably extends through the stub (352) on the disk holder (35). The disk holder (35) has a slot (351) corresponding to the notches (211,221,231) in the disks (21,22,23) of the first disk set (20) and the second end of the lock bolt (45). The notches (211,221,231) in the disks (21,22,23) of the first set (20) are selectively aligned with the slot (351) in the disk holder (35) when the disks (21,22,23) are rotated.

The disk sets (20, 25) are operationally mounted along the axis of the base (10) and are respectively connected to the selecting disks (32, 34). Each disk set (20, 25) has multiple disks (21, 22, 23, 26, 27, 28) operationally mounted along the axis of the base (10) and connected to and driven by a respective one of the selecting disks. In the first embodiment, the lock cylinder assembly comprises two disk sets (20, 25) including a first disk set (20) and a second disk set (25).

To operationally connect the disks (26,27,28), the second driving disk (28) has a driving post (282) extending toward an adjacent second driven disk (27). The second driven disk (27) adjacent to the second driving disk (28) has a driven post (273) and a driving post (272). The driven post (273) is formed on and extends from the second driven disk (27) at one side facing the second driving disk (28) and corresponds to and selectively abuts against the driving post (282) on the second driving disk (28). The driving post (272) is formed on and extends from the second driven disk (27) at one side away from the second driving disk (28). The second driven disk (26) far away from the second driving disk (28) has a driven post (262) formed on and extending from the second driven disk (26) at one side facing the adjacent second driven disk (27) and corresponding to and selectively abutting against the driving post (272) on the adjacent second driven disk (27). With the abutment between the driving posts (272,282) and the driven posts (262,273) on the disks (26,27,28), the second driven disks (26,27) will be rotated with the second driving disk (28) when the second selecting disk (34) is rotated.

In addition, the second disk set (25) further comprises multiple spacers (30) with multiple rotors mounted around the stub (352) on the disk holder (35) and between the disk holder (35), the second driven disks (26,27) and the second driving disk (28). With the arrangement of the spacers (30), the rotation of the driven disks (26,27) is at a lower friction and smooth.

When the first selecting disk (32) is rotated, the first driving disk (23) is rotated. When the driving post (232) on the first driving disk (23) abuts against the driven post (223) on the adjacent first driven disk (22), the adjacent first driven disk (22) will rotate with the first driving disk (23). When the driving post (222) on the first driven disk (22) adjacent to the first driving disk (23) abuts against the driven post (212) on the other first driven disk (21), the first driven disks (21,22) will be rotated simultaneously. When the first driven disk (21) away from the first driving disk (23) is rotated to a position where the notch (211) in the first driven disk (21) is in aligning with the slot (351) in the disk holder (35), the first selecting disk (32) is rotated in reverse. Accordingly, both first driven disks (21,22) are kept from rotating until the driving post (232) on the first driving disk (23) abuts against the driven post (223) on the adjacent first driven disk (22). Consequently, the first driven disk (22) adjacent to the first driving disk (23) is rotated, but the first driven disk (21) away from the first driving disk (23) is also kept stationary.

When the first driven disk (22) adjacent to the first driving disk (23) is rotated to a position where the notch (221) is in aligning with the slot (351) in the disk holder (35), the first selecting disk (34) is rotated in reverse again to make the notch (231) in the first driving disk (23) in aligning with the notches (211,221) in the driven disks (21,22) and the slot (351) in the disk holder (35). Thus, the notches (211,221, 231) in the disks (21,22,23) of the first disk set (20) are aligned with each other by means of rotating the first selecting disk (32) in alternative directions. The operation of aligning the notches (261,271,281) in the disks (26,27,28) of the second disk set (25) is same as that of the first disk set (20) but by rotating the second selecting disk (34) and further description is omitted.

When the notches (211,221,231,261,271,281) in the disks (21,22,23,26,27,28) of both disk sets (20,25) are aligned with each other, a space for the second end of the lock bolt (45) of the lock device extending into is defined. When the second end of the lock bolt (45) is extended into the space implemented by the notches (211,221,231,261,271,281) and the slot (351), the lock bolt (45) is escaped from a lock cavity so that the lock device with the lock cylinder assembly is in an unlocked condition.

Accordingly, to unlock the lock cylinder assembly needs six passwords for aligning the notches (211,221,231,261, 271,281), so the lock device with the lock cylinder assembly in accordance with the present invention is difficult unlocked by unauthorized person. In addition, the disks (21,22,23,26, 27,28) of the disk sets (20,25) can be arranged in different amounts, so to unlock the lock cylinder assembly is very complicated for any person who does not know passwords and the safety of using the lock cylinder assembly is improved.

Figure 8:
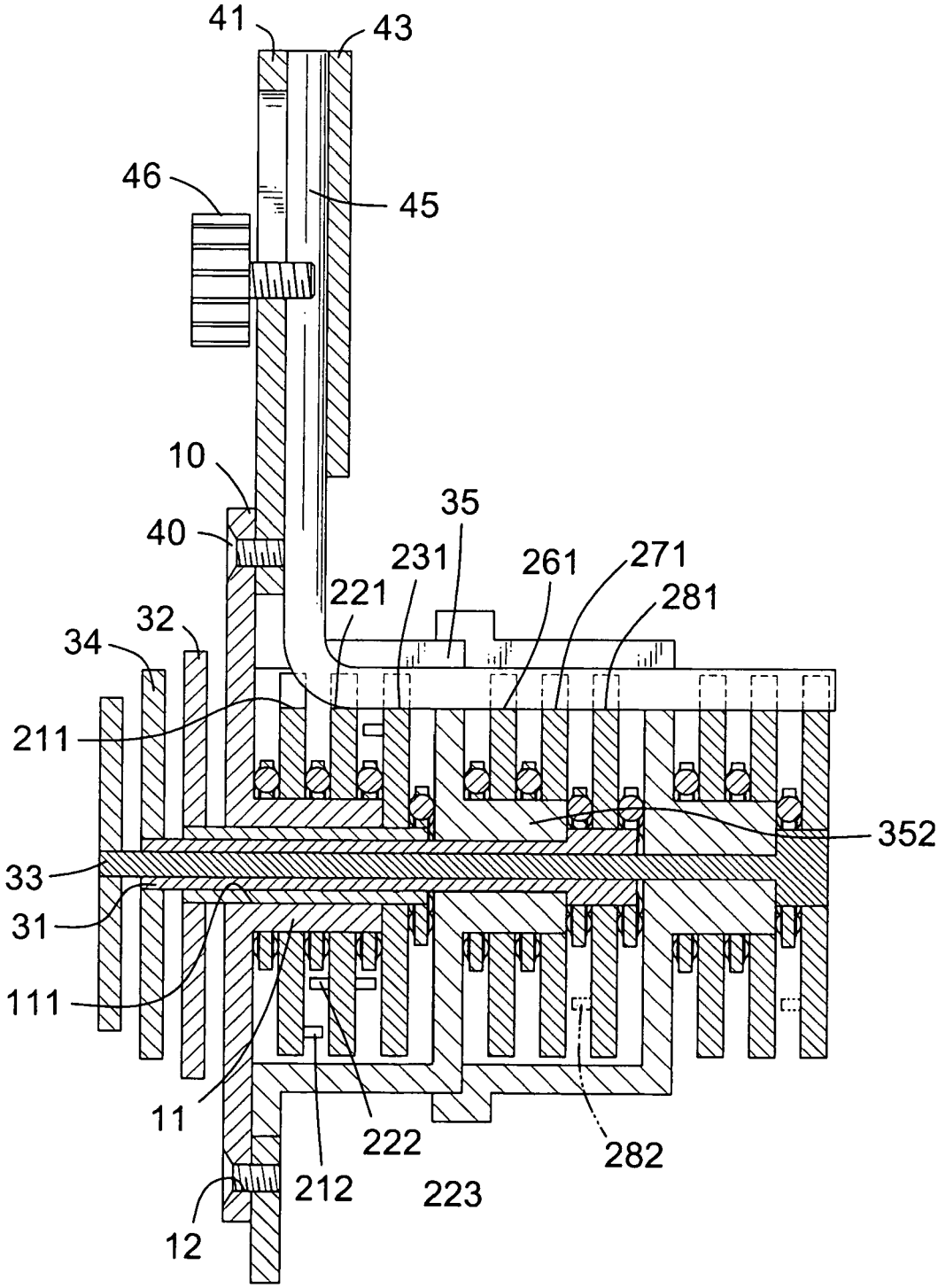
FIG. 8 is a side plan view in partial section of a further embodiment of a lock device with a lock cylinder assembly in accordance with the present invention.
Figure 9:
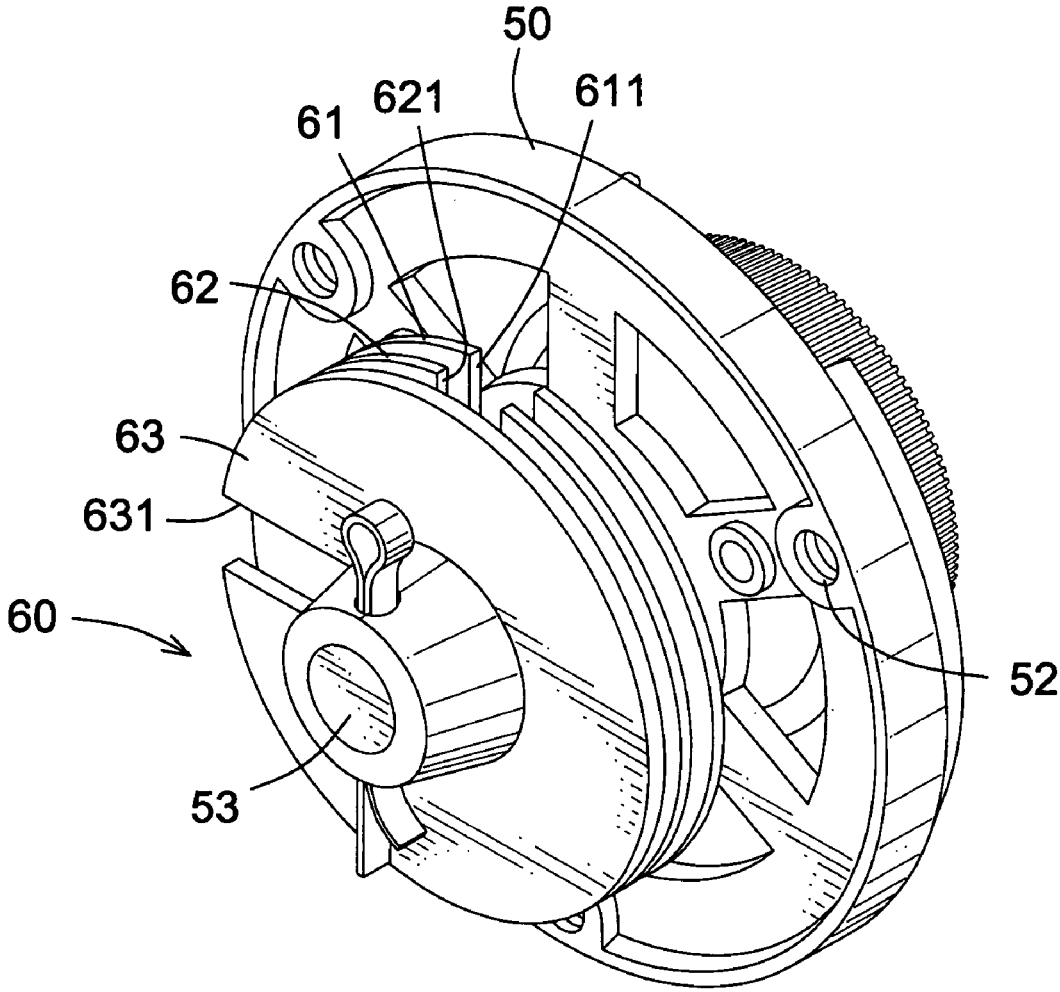
FIG. 9 PRIOR ART
FIG. 9 is a perspective view of a conventional lock cylinder assembly in accordance with the prior art.
Figure 10:
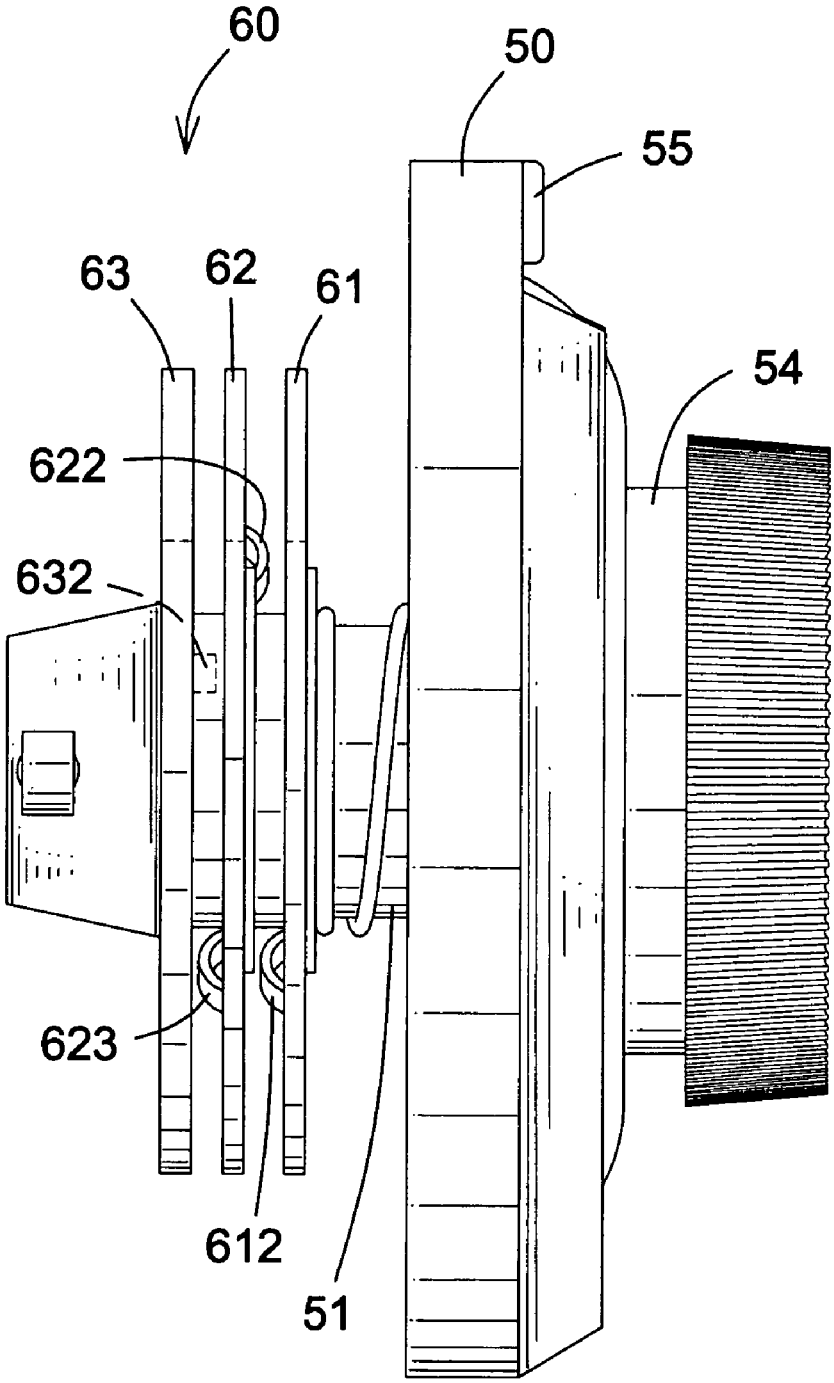
FIG. 10 PRIOR ART
FIG. 10 is a side plan view of the conventional lock cylinder assembly in FIG. 8.

With reference to FIG. 8, the lock cylinder assembly may have three or more than three disk sets by attaching at least one auxiliary holder onto the disk holder (35) to make the additional disk sets to be mounted along the axis of the base (10). Accordingly, with the increase of the amount of the disk sets, to unlock the lock cylinder assembly is more complicated and difficult.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock cylinder assembly comprising:

a base having an axis and a central tube extending from the base along the axis;

a disk holder attached to the base and having a stub axially protruding from the disk holder;

a driving sleeve rotatably extending through the central tube on the base and having an outer end and an inner end;

a driving rod rotatably extending through the stub on the disk holder and the driving sleeve and having an outer end extending out of the outer end of the driving sleeve, the driving rod having an inner end extending out of the inner end of the driving sleeve;

multiple selecting disks rotatably connected to the base along the axis of the base, two selecting disks being connected to the base and including a first selecting disk and a second selecting disk, the first selecting disk being securely mounted on the outer end of the driving sleeve, the second selecting disk being securely mounted on the outer end of the driving rod; and multiple disk sets operationally mounted along the axis of the base and respectively connected to the selecting disks, and each disk set comprising multiple disks operationally mounted along the axis of the base and connected to and driven by a respective one of the selecting disks, two disk sets being connected to the base and respectively connected to the selecting disks and includes a first disk set and a second disk set, the first disk set being held inside the disk holder, the first disk set being rotatably connected to the first selecting disk with the driving sleeve and includes a first driving disk securely mounted on the inner end of the driving sleeve and at least one first driven disk rotatably mounted around the central tube on the base and connected to and driven by the first driving disk, and each of the first driving disk and the at least one first driven disk having a notch defined in a periphery of the disk, the second disk set being rotatably connected to the second selecting disk with the driving rod and includes a second driving disk securely mounted on the inner end of the driving rod and at least one second driven disk rotatably mounted around the stub on the disk holder and connected to the second driving disk, and each of the second driving disk and the at least one second driven disk having a notch defined in a periphery of the disk.

2. The lock cylinder assembly as claimed in claim 1, wherein the disk holder has a slot corresponding to the notches in the disks of the first disk set, and the notches in the disks of the first set are selectively aligned with the slot in the disk holder when the disks are rotated.

3. The lock cylinder assembly as claimed in claim 2, wherein the first disk set has two first driven disks mounted around the central tube on the base;

the first driving disk has a driving post extending toward an adjacent first driven disk;

the first driven disk adjacent to the first driving disk has a driven post formed on an extending from the first driven disk at one side facing the first driving disk and corresponding to and selectively abutting against the driving post on the first driving disk; and a driving post formed on an extending from the first driven disk at one side away from the first driving disk; and the first driven disk far away from the first driving disk has a driven post formed on an extending from the first driven disk at one side facing the adjacent first driven disk and corresponding to and selectively abutting against the driving post on the adjacent first driven disk.

4. The lock cylinder assembly as claimed in claim 3, wherein the second disk set has two second driven disks mounted around the stub on the disk holder;

the second driving disk has a driving post extending toward an adjacent second driven disk;

the second driven disk adjacent to the second driving disk has a driven post formed on an extending from the second driven disk at one side facing the second driving disk and corresponding to and selectively abutting against the driving post on the second driving disk; and a driving post formed on an extending from the second driven disk at one side away from the second driving disk; and the second driven disk far and away from the second driving disk has a driven post formed on and extending from the second driven disk at one side facing the adjacent second driven disk and corresponding to and selectively abutting against the driving post on the adjacent second driven disk.

5. The lock cylinder assembly as claimed in claim 4, wherein the first disk set further comprises multiple spacers with multiple rotors mounted around the central tube on the base and between the base, the first driven disks and the first driving disk.

6. The lock cylinder assembly as claimed in claim 5, wherein the second disk set further comprises multiple spacers with multiple rotors mounted around the stub on the disk holder and between the disk holder, the second driven disks and the second driving disk.

7. The lock cylinder assembly as claimed in claim 1, wherein the first disk set has two first driven disks mounted around the central tube on the base;

the first driving disk has a driving post extending toward an adjacent first driven disk;

the first driven disk adjacent to the first driving disk has a driven post formed on and extending from the first driven disk at one side facing the first driving disk and corresponding to and selectively abutting against the driving post on the first driving disk; and a driving post formed on and extending from the first driven disk at one side away from the first driving disk; and the first driven disk far away from the first driving disk has a driven post formed on an extending from the first driven disk at one side facing the adjacent first driven disk and corresponding to and selectively abutting against the driving post on the adjacent first driven disk.

8. The lock cylinder assembly as claimed in claim 7, wherein the second disk set has two second driven disks mounted around the stub on the disk holder;

the second driving disk has a driving post extending toward an adjacent second driven disk;

the second driven disk adjacent to the second driving disk has a driven post formed on an extending from the second driven disk at one side facing the second driving disk and corresponding to and selectively abutting against the driving post on the second driving disk; and a driving post formed on an extending from the second driven disk at one side away from the second driving disk; and the second driven disk far away from the second driving disk has a driven post formed on an extending from the second driven disk at one side facing the adjacent second driven disk and corresponding to and selectively abutting against the driving post on the adjacent second driven disk.

9. The lock cylinder assembly as claimed in claim 8, wherein the first disk set further comprises multiple spacers with multiple rotors mounted around the central tube on the base and between the base, the first driven disks and the first driving disk.

10. The lock cylinder assembly as claimed in claim 9, wherein the second disk set further comprises multiple spacers with multiple rotors mounted around the stub on the disk holder and between the disk holder, the second driven disks and the second driving disk.

11. The lock cylinder assembly as claimed in claim 1, wherein the second disk set has two second driven disks mounted around the stub on the disk holder;

the second driving disk has a driving post extending toward an adjacent second driven disk;

the second driven disk adjacent to the second driving disk has a driven post formed on and extending from the second driven disk at one side facing the second driving disk and corresponding to and selectively abutting against the driving post on the second driving disk; and a driving post formed on and extending from the second driven disk at one side away from the second driving disk; and the second driven disk far away from the second driving disk has a driven post formed on an extending from the second driven disk at one side facing the adjacent second driven disk and corresponding to and selectively abutting against the driving post on the adjacent second driven disk.

12. The lock cylinder assembly as claimed in claim 11, wherein the first disk set further comprises multiple spacers with multiple rotors mounted around the central tube on the base and between the base, the at least one first driven disk and the first driving disk.

13. The lock cylinder assembly as claimed in claim 12, wherein the second disk set further comprises multiple spacers with multiple rotors mounted around the stub on the disk holder and between the disk holder, the second driven disks and the second driving disk.

14. The lock cylinder assembly as claimed in claim 1, wherein the first disk set further comprises multiple spacers with multiple rotors mounted around the central tube on the base and between the base, the at least one first driven disk and the first driving disk.

15. The lock cylinder assembly as claimed in claim 14, wherein the second disk set further comprises multiple spacers with multiple rotors mounted around the stub on the disk holder and between the disk holder, the at least one second driven disk and the second driving disk.

16. The lock cylinder assembly as claimed in claim 1, wherein the second disk set further comprises multiple spacers with multiple rotors mounted around the stub on the disk holder and between the disk holder, the at least one second driven disk an the second driving disk.

* * * * *